US010501215B2

(12) United States Patent
Evers et al.

(10) Patent No.: US 10,501,215 B2
(45) Date of Patent: Dec. 10, 2019

(54) PACKAGING MACHINE

(71) Applicant: MEURER VERPACKUNGSSYSTEME GMBH, Fürstenau (DE)

(72) Inventors: Jürgen Evers, Spelle (DE); Bernt Schulz, Ibbenbüren (DE); Linus Wöhle, Schapen (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 795 days.

(21) Appl. No.: 14/894,738

(22) PCT Filed: May 28, 2014

(86) PCT No.: PCT/DE2014/000267
§ 371 (c)(1),
(2) Date: Nov. 30, 2015

(87) PCT Pub. No.: WO2014/190966
PCT Pub. Date: Dec. 4, 2014

(65) Prior Publication Data

US 2016/0122044 A1 May 5, 2016

(30) Foreign Application Priority Data

May 31, 2013 (DE) ..... 10 2013 009 229

(51) Int. Cl.
*B65B 5/06* (2006.01)
*B65B 35/40* (2006.01)
(Continued)

(52) U.S. Cl.
CPC ..... *B65B 5/06* (2013.01); *B65B 5/02* (2013.01); *B65B 5/105* (2013.01); *B65B 5/106* (2013.01);
(Continued)

(58) Field of Classification Search
CPC ..... B65B 5/16; B65B 5/105; B65B 35/40; B65B 5/02; B65B 35/44; B65B 5/08
(Continued)

(56) References Cited

U.S. PATENT DOCUMENTS 3,327,450 A * 6/1967 Carter ..... B65B 21/18 294/93
5,060,455 A * 10/1991 Schmeisser ..... B65B 21/18 53/247
(Continued)

FOREIGN PATENT DOCUMENTS

DE 22 40 541 A1 5/1973
DE 44 34 866 A1 4/1996
(Continued)

*Primary Examiner* — Robert F Long
*Assistant Examiner* — Xavier A Madison
(74) *Attorney, Agent, or Firm* — Pauley Erickson & Kottis

(57) ABSTRACT

A packaging machine for boxing products that are brought together to form a group in a box includes a first conveyor device on which the products are conveyed to a collection station, and a second conveyor device by which the box, which is provided in a loading station to be filled with products, is conveyed away after being filled. A collection table is provided on which the groups are brought together, and an insert tool arranged above the collection table and loading station and which grasps a group brought together on the collection table and inserts them into a box provided in the loading station. The collection table is provided between first and second conveyor devices, and a stop, a clamp and a slider are provided such that the products are conveyed from the first conveyor device towards the stop and a defined number of products then move together.

12 Claims, 5 Drawing Sheets

(51) Int. Cl.
*B65B 5/10* (2006.01)
*B65B 35/44* (2006.01)
*B65B 5/02* (2006.01)

(52) U.S. Cl.
CPC ..... *B65B 5/108* (2013.01); *B65B 35/40* (2013.01); *B65B 35/44* (2013.01)

(58) Field of Classification Search
USPC ..... 53/534, 537
See application file for complete search history.

(56) References Cited

U.S. PATENT DOCUMENTS

| | | | | | |
|---|---|---|---|---|---|
| 5,927,053 | A * | 7/1999 | Donovan | B65B 35/40 | 53/168 |
| 6,164,045 | A * | 12/2000 | Focke | B65B 5/105 | 198/429 |
| 2011/0154784 | A1* | 6/2011 | Poutot | B65B 5/024 | 53/443 |

FOREIGN PATENT DOCUMENTS

| | | | |
|---|---|---|---|
| DE | 198 21 969 | A1 | 11/1999 |
| DE | 10 2011 002 575 | A1 | 7/2012 |
| EP | 0 092 402 | A2 | 10/1983 |
| EP | 0 959 002 | A1 | 11/1999 |
| EP | 1 602 580 | A1 | 12/2005 |

* cited by examiner

PACKAGING MACHINE

BACKGROUND OF THE INVENTION

Field of the Invention

The invention relates to a packaging machine for boxing products that have been brought together to form a group into a box, with a first conveyor device on which the products are conveyed one behind the other to a collecting station, a second conveyor device by means of which the boxes that are prepared in a loading station for filling them with products are conveyed away after being filled, a collecting table which is provided in the collecting station and on which the groups of products are brought together, and an inserting tool that is arranged above the collecting table and loading station and that picks up a group of products brought together on the collecting table and inserts them into a box provided in the loading station.

Discussion of Related Art

Such a packaging machine is known, for example, from EP 1 602 580 A1. In this machine, the inserting tool is provided not only for lifting up the grouped products from the collecting table and inserting them into the open box from above in the loading station, but is also used to lift up products, which have been supplied by the first conveyor device and have accumulated against a stop, and to transfer them to the collecting table. The loading station and the collecting table are positioned on opposite sides of the first conveyor device, which is comprised of a conveyor belt that is driven in revolving fashion. Because first, the group formation and then the insertion of the group into the box are carried out by the same tool, the machine, which is incidentally embodied in the form of a semiautomatic packaging machine, operates in a correspondingly slow fashion. Given this situation, the packaging machine should be improved so that the packaging can be carried out more quickly and simply.

SUMMARY OF THE INVENTION

The problem can be solved by a packaging machine of this generic type, which is characterized in that the collecting table is provided between the first and second conveyor devices; a stop, a clamp, and a slider are provided in the collecting station and cooperate with one another in such a way that i) the products are conveyed by the first conveyor device against the stop and a defined number of products then accumulates, ii) the clamp is provided to hold at least the products immediately following the defined number of products so that these products cannot be conveyed any further despite the uninterrupted operation of the first conveyor device; and iii) the slider pushes the defined number of products onto the collecting table for as long as the clamp is clamping the product.

This embodiment separates the tool for inserting the products into the open box from the tool that carries out the group formation. The two tools only have to travel for short working strokes. The group formation can already be taking place again once the inserting tool has taken the group that has collected on the collecting table and is making its way into the loading station. The working cycle of the packaging machine is thus significantly shortened.

In order to be able to adjust the defined number of products accumulating against the stop, the position of the stop relative to the first conveying direction is adjustable. The clamp can be stationary relative to the machine.

Preferably, a detection device for detecting the groups is provided under the collecting table and is able to detect whether the group of products is complete so that a signal can then be sent to the inserting tool to pick up the group and transport it into the loading station.

To this end, the collecting table can preferably have a transparent or translucent plate so that a camera can be used as the detection device.

In order to be able to insert several layers or product groups into a box, a magazine of intermediate layers can be provided on the side of the second conveyor device opposite from the collecting table. If the inserting tool can be moved over the intermediate layer magazine, then it can pick up an intermediate layer from the magazine and place it onto the product group that has already been inserted into the box. Such an intermediate layer is for example made of a thin paperboard. The inserting tool is preferably embodied in the form of a suction device.

If the collecting table, the loading station, and the intermediate layer magazine each have a zero edge that is stationary relative to the machine and the distance between the zero edge of the collecting table and the zero edge of the loading station is identical to the distance between the zero edge of the loading station and the zero edge of the intermediate layer magazine, then the control for the inserting tool can be simply designed. The path that the inserting tool must travel after picking up the product group on the collecting table in order to insert the products into the box is then identical to the path that the inserting tool must then travel in order to pick up an intermediate layer. With this design, it is then possible to also provide a second inserting tool that works in the opposite direction from the first inserting tool and inserts an intermediate layer after a group of products has been inserted by the first inserting tool. This further increases the operating speed of the packaging machine.

Preferably, an identical vertical working plane is defined for the collecting table, the loading station, and the intermediate layer magazine, which constitutes the respective zero line for the start of the working operation of the inserting tool with regard to the conveying direction F. In other words, the last product of the particular number of products assumes a defined position on the collecting table. The inserting tool picks up the product group on the vertical working plane, inserts it into the open box along this vertical working plane, and also along this vertical working plane, takes an intermediate layer from the intermediate layer magazine when needed.

With this embodiment, it is then also easily possible to provide a second inserting tool when needed, which likewise starts its work operation at this zero line. The second inserting tool can work independently of the first inserting tool. It can, however, also be rigidly coupled to the first inserting tool, and moved together with it in the movement direction. Then all that is needed is for it to be supported so that it can move freely in the vertical direction, independently of the first inserting tool.

The inserting tool(s) is/are preferably accommodated on a carriage that is able to move in the vertical direction (z direction) along a support. In particular, this carriage can preferably be supported so that it is able to move in a horizontal direction (y direction) on the frame.

Preferably, the supports of the carriage are rigidly coupled to one another in order to work together. In this case, the first inserting tool then picks up the product group waiting on the collecting table, while at the same time, the second inserting tool places an intermediate layer onto a product group that is already in the box. When the first inserting tool, together with the product group taken from the collecting table, then travels toward the loading station, the second inserting tool travels back to the intermediate layer magazine and picks up a new intermediate layer, while the first inserting tool inserts the second picked-up product group into the box.

An exemplary embodiment of the invention will be described in greater detail with the aid of the drawings.

DETAILED DESCRIPTION OF THE INVENTION

The packaging machine preferably functions in a fully automatic fashion. Individual box blanks are taken from a box magazine 10, automatically erected in an erecting station 13, and then the box 6, after being erected and glued at the bottom, is transported into the loading station B by means of drivers 5' of the second conveyor device 5.

Figure 4:
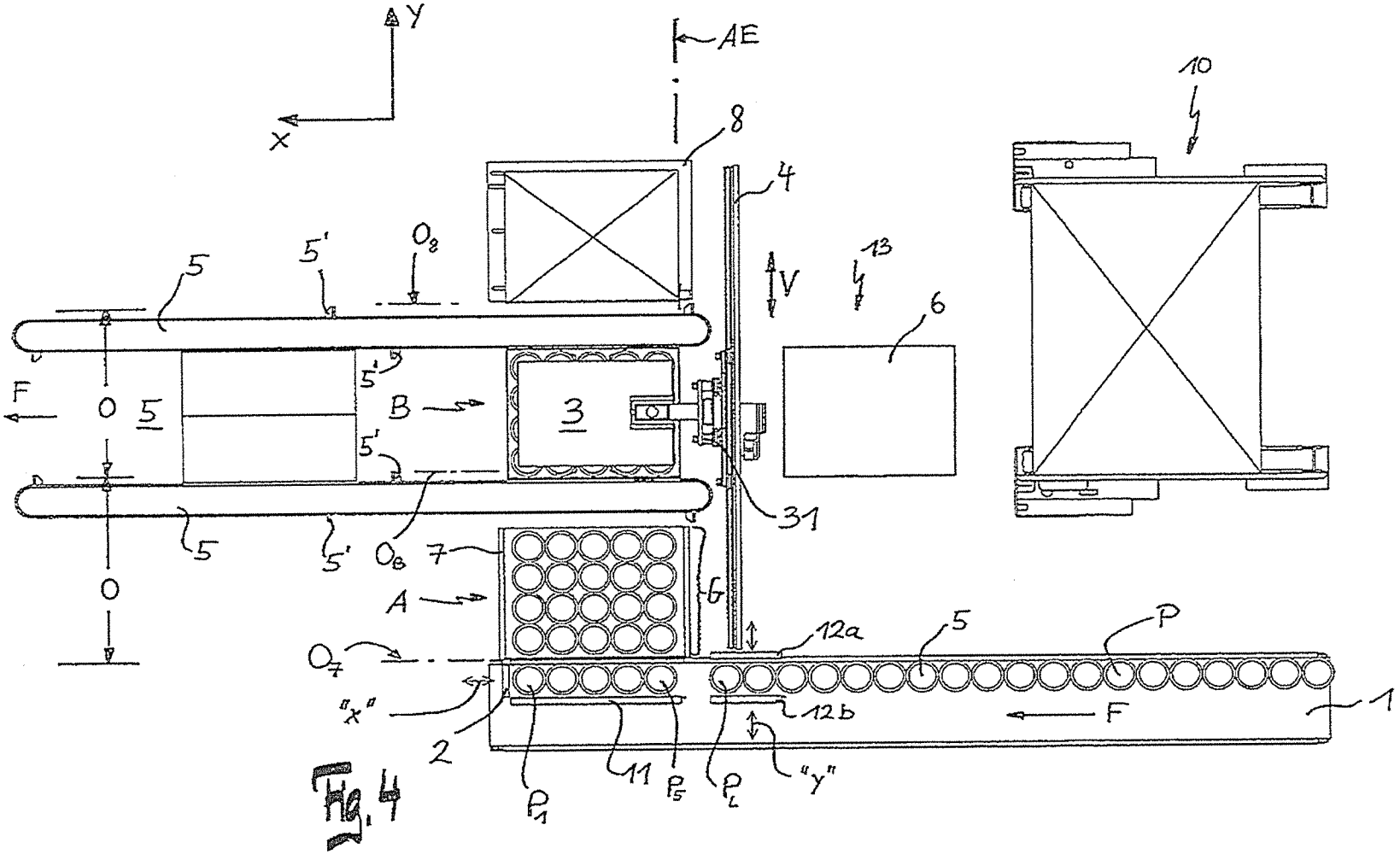
FIG. 4 shows a top view of the packaging machine.

The first conveyor device 1, which is composed of a conveyor belt that is driven in revolving fashion, transports individual products P one after the other into the collecting station A. At the end of the conveyor device 1, a stop 2 is provided, whose position relative to the conveying direction F (x direction) is adjustable (see viewing arrow "X" in FIG. 4). If the first product $P_1$ comes into contact with the stop 2, then all of the subsequent products P come into contact with one another. As FIG. 4 shows, a clamp 12 is provided downstream, which is situated above the conveyor device 1, is composed of clamping jaws 12*a*, 12*b*, can be moved along the viewing arrow "Y" (y direction), and is stationary relative to the machine. By adjusting the stop 2 in the upstream or downstream direction, it is possible to establish a defined number of products P that will accumulate before the clamp 12 is activated. The defined number of products P is a result of the product size and the distance between the stop 2 and the clamp 12. If the defined number of products P has been reached, then the clamp 12 holds at least the products P immediately adjoining the last product P5 of the accumulated products so that it is no longer possible to convey the products P further, even though the conveyor belt 1 continues to revolve. Then the slider 11 pushes the defined number of products $P_1$ to $P_5$ onto the collecting table 7 of the collecting station A. The line at which the slider 11 leaves products P that have been pushed onto the collecting table 7 (in its return movement), constitutes a zero edge $O_7$ of the collecting table 7. The pushing of the products $P_1$ to $P_5$ accumulating in the defined number at stop 2 continues to occur until a certain size of the group G of products P is reached. In the figures, the group G is composed of 20 products: four rows with a defined number of five products each.

The support surface of the collecting table 7 is composed of a glass plate beneath which a camera 14 is provided, which detects whether the desired group size has been reached. If the group size has been reached, then the inserting tool 3, which is embodied as a suction plate, lifts up the entire group G and transfers it from the collecting station A into the loading station B. The inserting tool 3 is then brought to a stop over the box 6 and lowered into the loading station B so that the group G of products P is lowered into the box 6.

The line with which the box 6 rests against the side of the second conveyor device 5 facing the collecting table 7 constitutes the zero edge $O_B$ of the loading station B.

Figure 1:
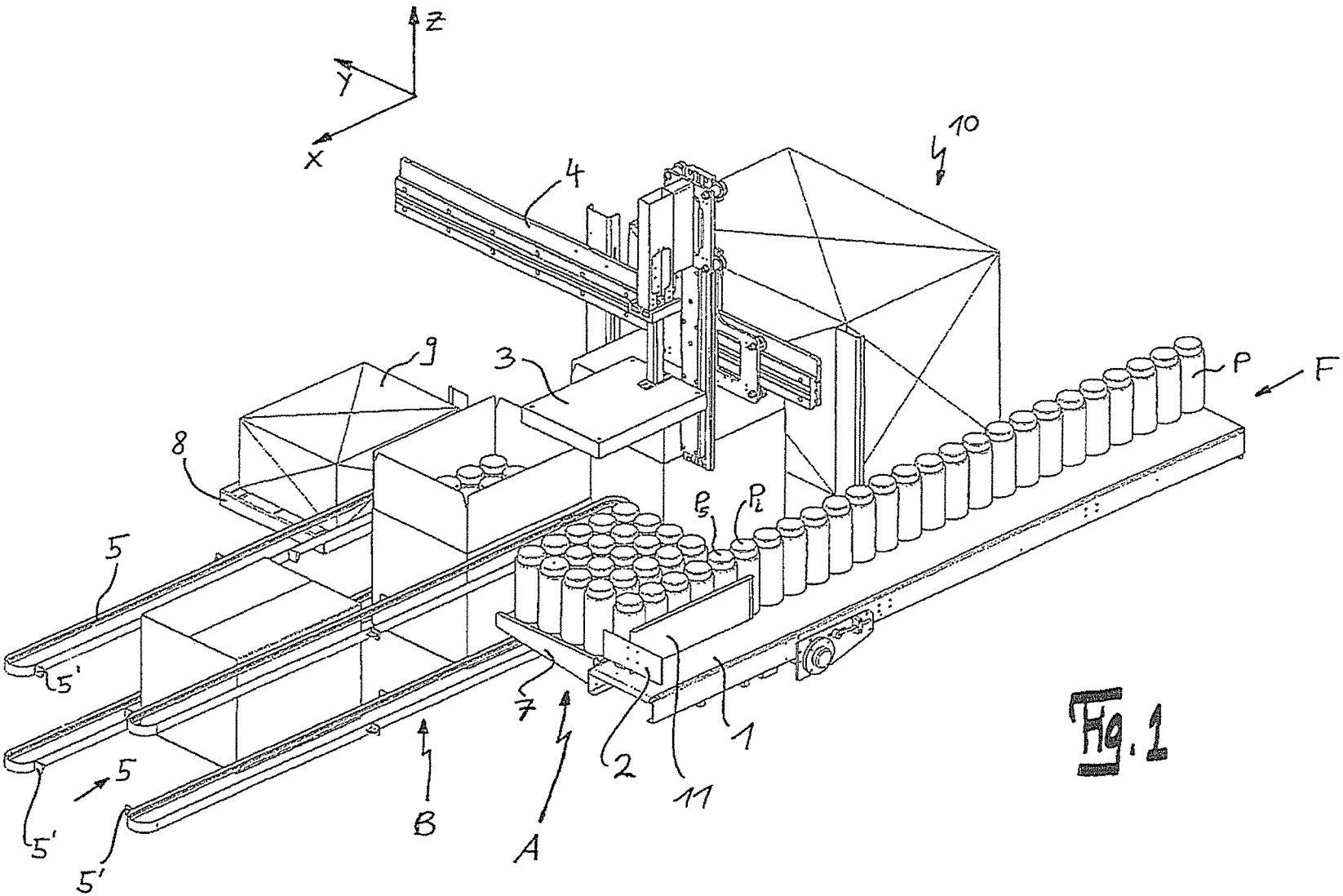
FIG. 1 shows a first perspective view of the packaging machine.

FIG. 1 shows that the inserting tool 3, which is guided on the frame 4, can pick up the product group G, which has accumulated on the collecting table 7, and immediately thereafter, the collection of a new group G of products P can begin. The clamp 12 is released from the product P as soon as the slider 11 in retracted into its original position. As soon as the product group G has been removed from the collecting table 7, a new first defined number of products P can be pushed onto the collecting table 7. As shown in FIG. 4, the clamping jaws 12*a*, 12*b* of the clamp 12 can also clamp two products P, which increases operational reliability.

Figure 5:
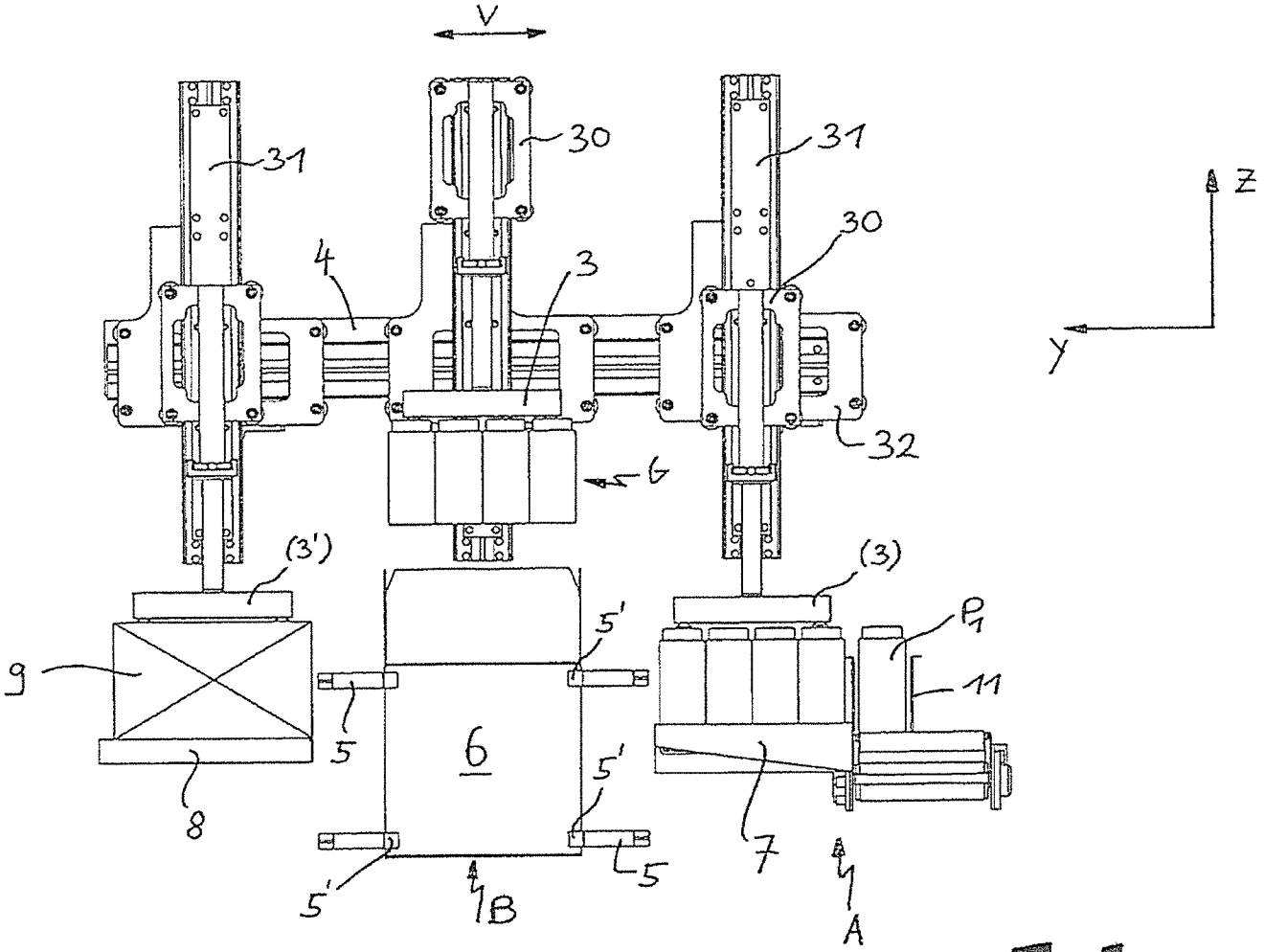
FIG. 5 shows a schematic partial view according to the viewing arrow V in FIG. 3.

In order to insert several layers of product groups into the boxes 6, i.e. in order to be able to stack them on top of one another, on the side of the second conveyor device 5 opposite from the collecting table 7, an intermediate layer magazine 8 can be provided, which contains a stack of layers of paperboard 9 that can be used to form a dividing floor between the individual product groups in the box 6. It is then possible for the inserting tool 3, after it has inserted a group G of products P into the box 6, to continue moving in the same direction V, pick up an intermediate layer 9 from the stack, place it onto the inserted product group G, and continue traveling toward the collecting table 7 in order to pick up the next group G of products P there. This is schematically depicted in FIG. 5. The possible positions for the inserting tool 3 above the product group G on the collecting table 7 or above the stack of intermediate layers 9 in intermediate layer magazine 8 are depicted with dashed lines. The position of the inserting tool 3 with the picked up product group G above the open box 6 is depicted with solid lines.

The line with which the stack of intermediate layers 9 adjoins the intermediate layer magazine 8 toward the conveyor device 5 constitutes a zero edge $O_8$ for the intermediate layer magazine 8. The distance O between the zero edge $O_7$ and the zero edge $O_B$ is identical to the distance between the zero edge $O_B$ and the zero edge $O_8$.

The zero edges $O_7$, $O_B$, and $O_8$ thus extend equidistant and parallel to one another. This simplifies the control for the inserting tool 3. The tool always has to travel the same distance, regardless of whether a group G of products P is being inserted into an erected box 6 or an intermediate layer 9 is being picked up from the intermediate layer magazine 8 and is to be inserted into the box 6. This also offers the advantage that an additional inserting tool 3 could also be provided on the frame 4 and the two inserting tools could then work simultaneously. The first inserting tool 3 only places product groups G into the boxes 6 and the second inserting tool only inserts intermediate layers 9. It is then possible to speed up the timing of the packaging machine even more.

Figure 2:
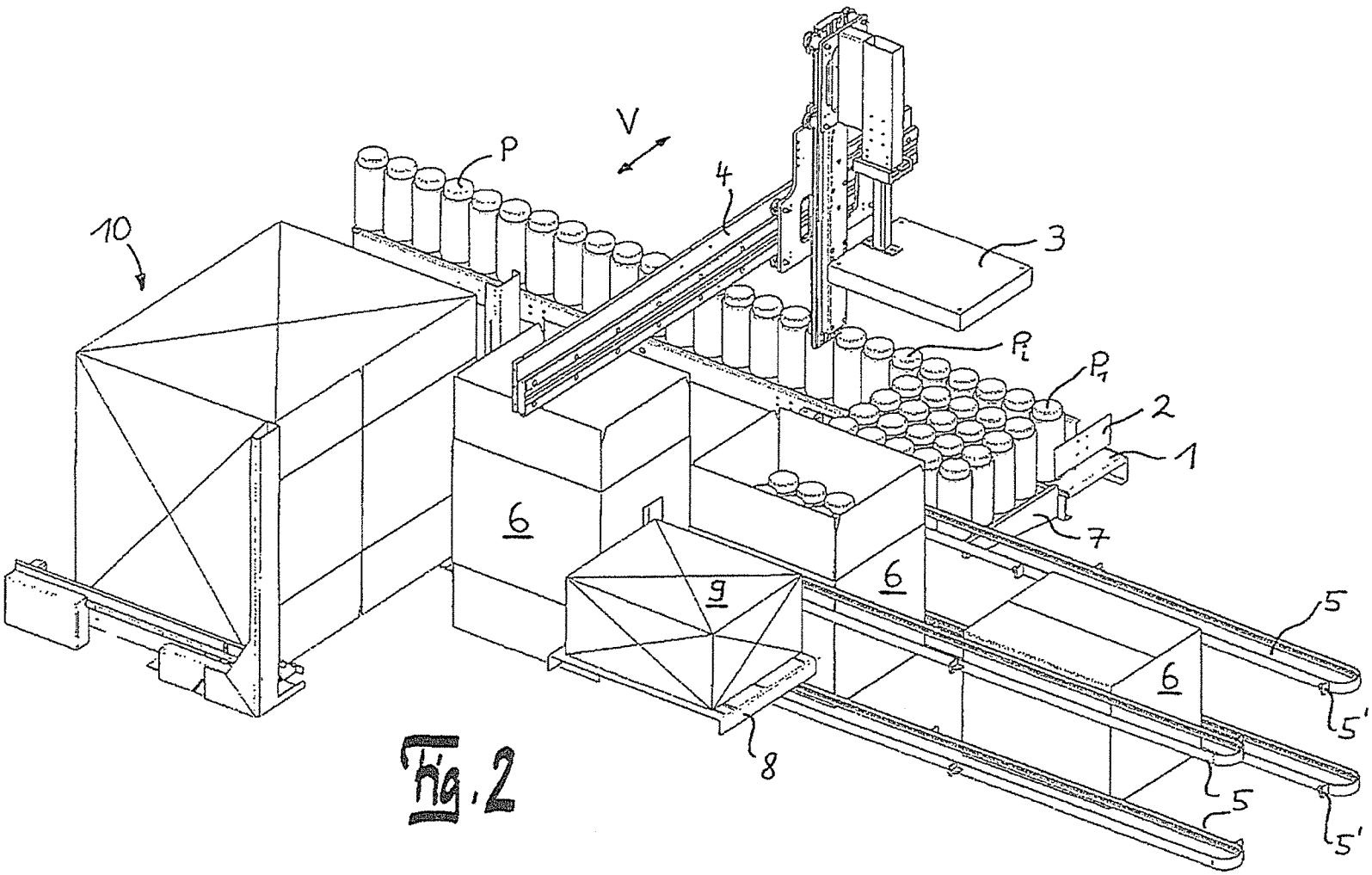
FIG. 2 shows a second perspective view of the packaging machine.
Figure 3:
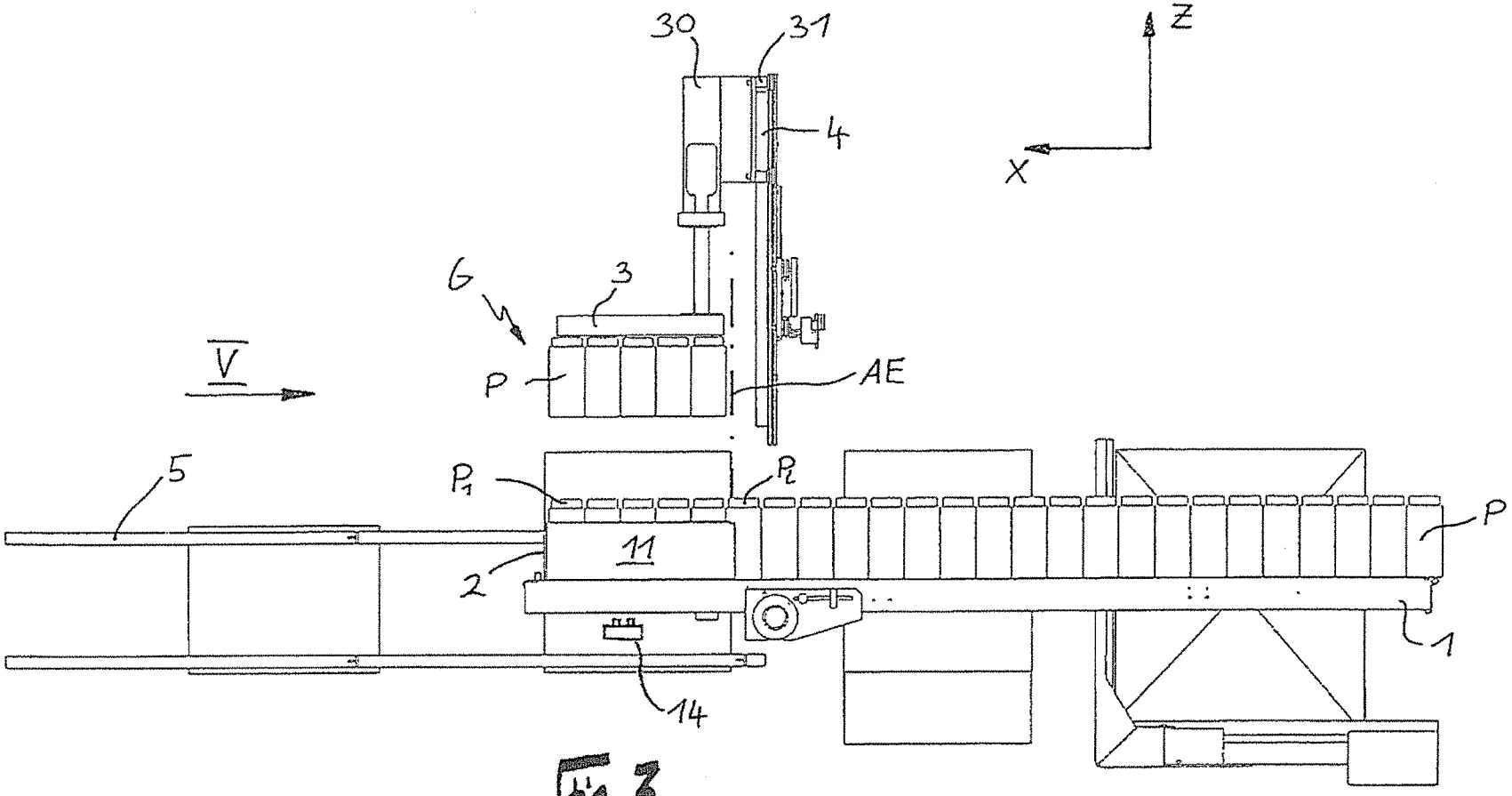
FIG. 3 shows a side view of the packaging machine.

As is clear from FIG. 2, the collecting table 7, the loading station B, and the support table 8 are positioned in a plane that is parallel to the movement direction V so that the inserting tool 3 can be slid only in this plane and vertically perpendicular to it. A sliding in the conveying direction F of the frame 4 does not occur and is also not needed.

FIG. 5 shows that the inserting tool 3 is fastened to a carriage 30, which is supported so that it is able to move in the vertical direction (z direction) on a support 31. The support 31 is fastened to a carriage 32, which is supported so that it is able to move in the horizontal direction (y direction) on the frame 4.

FIG. 5 also shows that two simultaneously operating inserting tools 3, 3' can be used. The supports 31 that are associated with the inserting tools 3, 3' can be rigidly connected to each other for this purpose. In other words, they travel simultaneously over the same sliding distance V. The second inserting tool 3' is supported on the carriage 30 so that it can be slid in the vertical direction (z direction) and can be separately driven in the z direction by the control unit, not shown here, of the packaging machine. While the second inserting tool 3' is picking up an intermediate layer 9, the first inserting tool 3 is inserting a product group G into the box 6. When the first inserting tool 3 then continues to travel toward der collecting station A, the second inserting tool 3' then travels with the intermediate layer 9 into the loading station B and can place the intermediate layer 9 onto the product group G that has been inserted into the box 6 while the first inserting tool 3 is picking up a new product group G from the collecting table 7.

The invention claimed is:

1. A packaging machine for boxing products (P), which have been brought together to form a group (G), into a box (6), comprising:

a) a first conveyor device (1) on which the products (P) are conveyed one behind the other to a collecting station (A), wherein a stop (2), a clamp (12), and a slider (11) are provided, which cooperate with one another so that the first conveyor device (1) conveys products (P) against the stop (2) and then a defined number products (P1 to P5) come into contact with one another, and the clamp (12) is provided to hold at least a product (Pi) immediately following the defined number of products (P1 to P5) so that the products (P) cannot be conveyed any further despite uninterrupted operation of the first conveyor device (1) passing under the products (P);

b) a second conveyor device (5) by means of which the boxes (6) that are prepared in a loading station (B) for filling them with products (P) are conveyed away after being filled;

c) a collecting table (7) which is provided in the collecting station (A) and on which the group (G) of products (P) is brought together, wherein the slider (11) repeatedly pushes the defined number products (P1 to P5) onto the collecting table (7), each time while the clamp (12) is clamping the product (Pi) and until the group (G) of products (P) is complete;

d) an intermediate layer magazine (8) on a side of the second conveyor device (5) opposite from the collecting table (7); and e) an inserting tool (3) that is situated above the collecting table (7) and the loading station (B) and that picks up the group (G) of products (P) that has been brought together on the collecting table (7) and inserts the group into a box (6) provided in the loading station (B), wherein the inserting tool is movable over the intermediate layer magazine (8).

2. The packaging machine according to claim 1, wherein a position of the stop (2) with reference to the first conveyor device (1) is adjustable to change a number of the defined number of products.

3. The packaging machine according to claim 1, wherein a detection device for detecting the groups (G) of products (P) is provided under the collecting table (7).

4. The packaging machine according to claim 3, wherein the collecting table (7) includes a transparent or translucent plate and the detection device is a camera (14).

5. The packaging machine according to claim 1, wherein the collecting table (7), the loading station (B), and the intermediate layer magazine (8) each include a zero edge (O7, OB, O8) that is stationary relative to the machine and a distance (O) between the zero edge (O7) of the collecting table (7) and the zero edge (OB) of the loading station (B) is identical to a distance between the zero edge (OB) of the loading station (B) and the zero edge (O8) of the intermediate layer magazine (8).

6. The packaging machine according to claim 5, wherein an identical vertical working plane (AE) is defined for the collecting table (7), the loading station (B), and the intermediate layer magazine (8), and constitutes a respective zero line for the start of the working operation of the inserting tool (3) with regard to the conveying direction (F).

7. The packaging machine according to claim 1, wherein the inserting tool (3, 3') is mounted on a carriage (30) movable in the vertical direction (z) along a support (31).

8. The packaging machine according to claim 7, wherein the support (31) is supported so that it is able to move in a horizontal direction (y) on the frame (4).

9. The packaging machine according to claim 7, wherein two or more supports (31) of the inserting tools (3, 3') are rigidly coupled to one another.

10. The packaging machine according to claim 1, wherein a second inserting tool (3') is provided.

11. The packaging machine according to claim 10, wherein the second inserting tool (3') is rigidly coupled to the first inserting tool (3).

12. The packaging machine according to claim 1, wherein the clamp (12) is provided to hold only the first two products immediately following the defined number of products (P1 to P5).

* * * * *